US011241086B1

(12) United States Patent
Sholeen

(10) Patent No.: US 11,241,086 B1
(45) Date of Patent: Feb. 8, 2022

(54) DISPOSABLE OR REUSABLE PAINT APPLICATOR PROTECTOR

(71) Applicant: Derek Sholeen, Dallas, TX (US)

(72) Inventor: Derek Sholeen, Dallas, TX (US)

(73) Assignee: Paint Poncho, LLC, Dallas, TX (US)

( * ) Notice: Subject to any disclaimer, the term of this patent is extended or adjusted under 35 U.S.C. 154(b) by 360 days.

(21) Appl. No.: 15/530,789

(22) Filed: Feb. 28, 2017

Related U.S. Application Data

(63) Continuation-in-part of application No. 14/756,344, filed on Aug. 31, 2015, now abandoned.

(51) Int. Cl.
*A46B 17/04* (2006.01)
*B05C 17/02* (2006.01)
*B44D 3/12* (2006.01)

(52) U.S. Cl.
CPC ..... *A46B 17/04* (2013.01); *B05C 17/0245* (2013.01); *B44D 3/125* (2013.01); *A46B 2200/202* (2013.01)

(58) Field of Classification Search
CPC ..... A46B 17/04; A46B 2200/202; B05C 17/0245; B44D 3/125
(Continued)

(56) References Cited

U.S. PATENT DOCUMENTS 2,533,829 A 12/1950 Merryweather
3,690,448 A 9/1972 Switzer
(Continued)

OTHER PUBLICATIONS

U.S. Appl. No. 13/986,143, filed Oct. 9, 2014, Awadallah.

*Primary Examiner* — Jacob K Ackun
(74) *Attorney, Agent, or Firm* — Spencer C. Patterson; Grable Martin Fulton PLLC

(57) ABSTRACT

An improved protective covering for paint brushes, paint rollers, and other paint applicators, consisting of a sheath of flexible, impermeable material. In one embodiment, a protector for a paint brush, roller or other paint applicator comprising a sheath of impermeable flexible material. Said sheath is comprised of two membranes. The inner membrane is polyethylene vinyl acetate, or ethylene vinyl acetate. This provides intrinsic adhesiveness thereby improving performance. The surface of said membrane has a frosted or translucent appearance. This membrane adheres to the paint on the tools for an improved barrier between the paint and oxygen. When the wet surface of the tool makes contact with the frosted membrane, the wet or paint shows through more clearly, while the dry areas maintain a frosted appearance, thereby indicating the product is working. The outer membrane is polyethylene plastic. The outer layer provides an extra barrier against moisture and air and, due to its ductility and impact strength, will act as an extra layer of protection against any punctures.

Figure 1A:
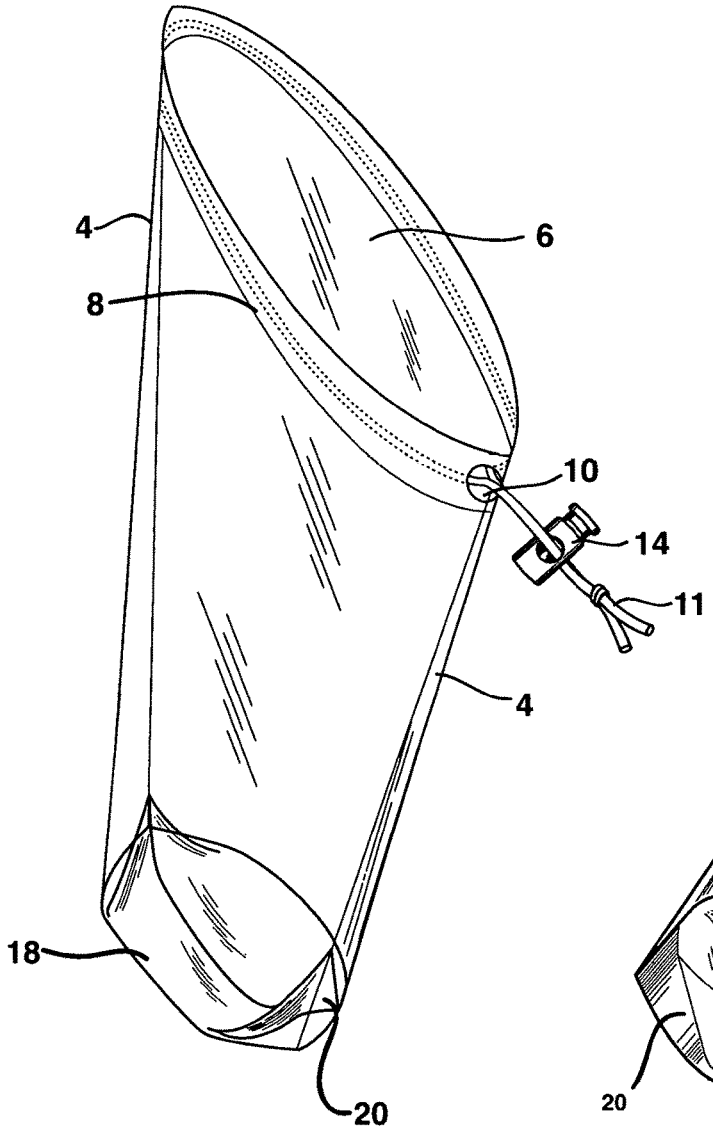

All sides of the covering are sealed except one. The width of the protector may narrow from the open end to the closed end. A casing is at the open end. An elastic cord is threaded through a small hole in the outer side of the casing, through the casing, and out of the hole. A lock is attached to the exposed portion of the elastic cord. The elastic cord and lock allow the user to adjust the seal that fits, or works, best for each painting tool. The improved protector is convenient to use, secure, and inexpensive. The cover is reusable or disposable, at the option of the user. Other embodiments are described and shown.

20 Claims, 9 Drawing Sheets

(58) Field of Classification Search
USPC ..... 383/72, 120; 206/209, 361, 362, 362.1, 206/362.2, 362.3, 15.2, 15.3
See application file for complete search history.

(56) References Cited

U.S. PATENT DOCUMENTS

| | | | | |
|---|---|---|---|---|
| 5,032,188 | A * | 7/1991 | Kettle | B44D 3/006 134/38 |
| 5,238,305 | A * | 8/1993 | Feller | A47K 3/281 383/117 |
| 5,346,311 | A * | 9/1994 | Siler | B65D 33/007 383/104 |
| RE34,929 | E * | 5/1995 | Kristen | B65D 31/02 206/524.8 |
| 5,709,301 | A | 1/1998 | Couch et al. | |
| 6,450,336 | B1 | 9/2002 | Edes | |
| 6,575,295 | B2 | 6/2003 | Mayfield | |
| 6,675,966 | B1 * | 1/2004 | Ray | A46B 17/04 206/362.4 |
| 6,757,931 | B2 | 7/2004 | Nordstrom | |
| 6,907,988 | B2 | 6/2005 | Jimenez | |
| 7,007,797 | B1 | 3/2006 | Ruccolo | |
| 7,140,061 | B2 | 11/2006 | Baker | |
| 7,207,437 | B1 | 4/2007 | Johansson | |
| 7,537,111 | B2 | 5/2009 | Hart et al. | |
| 7,927,430 | B2 | 4/2011 | Hart et al. | |
| 8,157,091 | B2 | 4/2012 | Gabbard | |
| 2010/0126893 | A1 * | 5/2010 | Sinykin | B05C 17/02 206/361 |

* cited by examiner

DISPOSABLE OR REUSABLE PAINT APPLICATOR PROTECTOR

CROSS-REFERENCE TO RELATED APPLICATIONS

This application is a CIP of Ser. No. 14/756,344, filed Aug. 31, 2015, which is a CIP of Ser. No. 14/120,942 filed Jul. 14, 2014 by the present inventor, which is incorporated by reference.

FEDERALLY SPONSORED RESEARCH OR DEVELOPMENT

Not Applicable

SEQUENCE LISTING OR COMPUTER PROGRAM

Not Applicable

BACKGROUND-FIELD OF INVENTION

The present invention relates to paint brush, paint roller and other paint applicator protectors, specifically, to an improved protective cover enclosing the applicator portion of a paint device in order to protect the device, both when dry or wet, thereby preserving the paint and painting device for use a short time later, i.e. within 48 hours; protecting the device from damage or drying out if wet with paint, stain, or similar application; and minimizing cleanup time and preparation for the next paint job.

BACKGROUND OF THE INVENTION

The use of several obvious configurations of devices to cover paint brushes and rollers is known in the prior art. A variety of different approaches were taken in the prior art. A series of devices are designed to provide long-term protection for clean, dry bristles or clean, wet and drying bristles of paint brushes: U.S. Pat. No. 6,575,295 to Mayfield, U.S. Pat. No. 6,757,931 to Nordstrom, U.S. Pat. No. 6,907,988 to Jimenez, U.S. Pat. No. 7,007,797 to Ruccolo, U.S. Pat. No. 7,140,061 to Baker et al. and U.S. Pat. No. 8,157,091 to Gabbard. In order to maintain the shape of the brush bristles, these are designed to compress the bristles using various methods and materials.

U.S. Pat. No. 6,575,295 to Mayfield, U.S. Pat. No. 6,757,931 to Nordstrom, U.S. Pat. No. 6,907,988 to Jimenez, and U.S. Pat. No. 8,157,091 to Gabbard operate by folding a rather confusing flexible configuration of flaps over the paint brush. U.S. Pat. No. 7,140,061 to Baker et al. is a tubular sleeve slipped over the length of the brush handle and onto the dry bristles. It is not designed to preserve a wet brush. Nor is U.S. Pat. No. 7,007,797 to Ruccolo, which is an open brush caddy with holes to provide air circulation to allow the brush to dry. However, none of these address the need for short term preservation of the brush in an air-tight environment in between uses. In addition, these devices are expensive, cumbersome, and difficult to use. Nor are they easily stored for quick accessibility when needed.

The prior art also includes rigid, allegedly liquid-tight containers to seal, until its next use, a wet paint brush such as U.S. Pat. No. 5,709,301 to Couch et al., and a wet paint roller such as U.S. Pat. No. 7,207,437 to Johannson. U.S. Pat. No. 5,709,301 to Couch et al. is a tube into which a paint roller that is covered with paint may be inserted and stored in paint until its next use. This patent includes a similar device for a brush in which the bristles are stored in paint until next use. U.S. Pat. No. 7,207,437 to Johannson comprises a rigid sleeve and boot that is slipped over the handle of a brush. The boot is attached to the sleeve with a hinge or chain and can be placed over the opening of the sleeve. All of these are expensive to manufacture and market and bulky to carry to job sites. They cannot be easily stored in a pocket. U.S. Pat. No. 7,207,437 to Johannson requires the user to touch the paint-covered bristles in order to insert the brush into the device. Obviously, this is undesirable.

U.S. Pat. No. 6,450,336 to Edes discloses a rubber sleeve that is unrolled over a wet paint brush to keep it from drying out. The use of this device is impracticable as the user must position the brush between his legs or some other holding device in order to cover the brush with the sleeve. The user will touch the paint-covered bristles while unrolling the sleeve onto the brush and get paint on their hands. This is extremely undesirable.

U.S. Pat. No. 3,690,448 to Switzer discloses a paint brush cover being a plastic envelope with an opening on the longest side and sealed by pressing one ribbed side into a grooved side. Prior to inserting the brush, the bristles are wrapped with plastic and a rubber band is placed in position to hold the wrapper in place. This cover is difficult to close properly. Moreover, wrapping the bristles and securing with a rubber band before inserting into the cover is twice the work to cover the brush.

U.S. Pat. No. 2,533,829 to Merryweather discloses a combination of paint brush and storage bag of rubber hydrochloride with such bag secured by a snap fastener and cord looped around the fastener. The rectangular shape of Merryweather makes it difficult to insert the paint tool and one can easily get paint on their hands when using this item. Furthermore, Merryweather has many drawbacks, including that it is expensive, nondisposable, does not have an airtight seal and the brush or roller would become dry and damaged. Its closure is clumsy and difficult to use. The closure can easily come open when unintended, which would result in damage to or loss of the paint brush. This could cause Merryweather to come open and damage the paint brush. Merryweather is also not airtight, not easy to use, not inexpensive to make and distribute, nor is the closure secure. The Merryweather fastener is inconvenient and time-consuming to use. Moreover, the user must very carefully arrange the folds of the material around the neck of the brush to achieve a seal; when the user is in a hurry, it is easy for the brush or roller to be damaged by a loose arrangement of the folds of material around the neck of the brush. The closure can easily come open when unintended, which would result in damage to or destruction of the paint brush.

A feature of my protector is its ease of use and convenience, including inserting the tool into the larger side of the trapezoid shaped protector. Ease of use and securely protecting the brush or roller are of great importance to the user. Keeping one's hands clean while securing a wet brush or roller is important to the user. After a painting job, most users are tired and in no mood to deal with cumbersome procedures to insert a brush or roller into an opening, nor to use a protector that can easily become unsecured and open. My protector solves these problems. The shape and design of my protector provides users a faster, easier, and neater solution to protecting their tools. The trapezoid shape provides the user up to 44% greater width at entry point, and approximately 50% more area space at entry point than a simple rectangle. The revolutionary trapezoid bag increases the space ratio between the painting tools at entry point, thus providing a faster, more convenient, less messy solution for the user.

In addition, the gusset in my protector provides superior protection to rollers or similarly shaped paint applicators by tightly conforming to the shape of the roller or tool. In protectors without a gusset, when the roller hits the end of the protector, the protector spreads out and away from the roller. My protector provides better protection since there is less air space next to the roller.

My protector has two membranes that protect the paint tool; the surface of the inner membrane has a frosted or translucent appearance that becomes more clear when the wet surface of the tool contacts the frosted membrane, thereby indicating the product is working. The outer membrane is polyethylene plastic, which has a high ductility and impact strength and as a result thereof, provides an not only an extra barrier against moisture and air, but also an extra layer of strength to protect against any punctures since it can withstand impacts, such as dropping or knocking against other tools or other hazards in the work environment. Even if the outside membrane somehow was punctured, the tools will still be protected by the inside membrane. In addition, my protector has an elastic cord and spring toggle locking system that is simple to use and cannot be opened except when desired. This aspect is required by users because protectors are used in an environment where many tools are carried simultaneously and bump into each other. My closure system can be used easily and quickly. The elastic cord and spring toggle locking system make my protector simple to use and reuse. My protector has a lock and cannot be opened except when desired.

U.S. Pat. Nos. 7,537,111 and 7,927,430 to Hart et al. provide for a flexible, sleeve-like cover for a paint brush into which the handle of the brush is slid and the end of such sleeve is folded over the bristles and sealed (and a method for same). Hart requires the user to slowly and carefully insert the handle of the brush into a hole in the sleeve, then carefully roll or push up the cover to encompass the bristles, being careful not to touch the paint-laden bristles.

This device may not operate in an airtight manner due to the nature of the opening around the brush handle. The opening may easily be loosened, allowing air to reach the brush and damage it. Or the device may slip or slide down the brush handle, breaking the seal around the handle and allowing air to damage the brush. This device is not reusable since one end must be ripped open to release the brush. The closure end of the device for brushes, once sealed, cannot be re-opened. The device described in the Hart reference is rectangular in shape and therefore difficult to put a paintbrush into the bag. If the cover is enlarged, then is can allow air inside the protector and cause the brush to dry out faster than if there were no air (as shown in FIG. 1 of U.S. Pat. No. 7,927,430, for example). The roller in the Hart embodiment simply lays inside the bag, surrounded by air, thus decreasing the time the roller may safely be stored, and negatively impacting the condition of the roller. Hart teaches a string or cord to secure the protector, but the string is simply threaded through holes in the protector, which is then prone to being tom and the airtight seal lost, thereby rendering the protector unusable and damaging the paint brush. In operation, Hart requires the user to slowly and carefully insert the handle of the brush into a hole in the sleeve (Hart column 10), then carefully roll or push up the cover to encompass the bristles, being careful not to touch the paint-laden bristles. This is time consuming and more than likely the user will get paint on their hands, which is a big drawback to Hart. After a painting job, most people are tired and in no mood to deal with cumbersome procedures to insert a bush or roller into an opening, nor to use a protector that can easily become unsecured and open. Hart is not reusable (must be torn to remove the brush), it cannot provide the strength of the outer membrane, its closure is not secure and safe from accidental opening, it is susceptible of losing its seal (and thus risks damage to brush or roller), and it is not convenient or easy to use.

My protector is easy to use and reuse, there is no mess, and the brush or roller is securely protected. My protector has two membranes protect the paint tool; the surface of the inner membrane has a frosted or translucent appearance that becomes more clear when the wet surface of the tool contacts the frosted membrane, thereby indicating the product is working. The outer membrane is polyethylene plastic, which has a high ductility and impact strength and as a result thereof, provides an extra barrier against moisture and air and acts as an extra layer of strength to protect against any punctures. Because this membrane is polyethylene plastic, it can withstand impacts, such as dropping or knocking against other tools. Furthermore, even if the outside membrane were punctured, the tools will still be protected by the inside membrane. Other unique features include the elastic cord enclosed in a casing and a toggle spring lock providing the user the control to adjust the seal that fits, or works, best for each painting tool, strong closure, gusseting, ease of use, double membranes, a frosted appearance of the inner membrane, a spring toggle lock on the closure, an elastic cord, and the trapezoid shape of the protector. The trapezoid shape of my protector provides the user with up to 44% greater width at entry point, and approximately 50% more area space at entry point than a simple rectangle. The revolutionary trapezoid protector increases the space ratio between the painting tools at entry point, thus providing a faster, more convenient, neater solution for the user.

Another novel feature of my protector providing is the gusset. The gusset causes the protector to conform to the roller and tightly adhere to surfaces covered with paint, thereby providing superior protection to the roller.

My protector has a sturdy and substantial closure: there is only one hole through the casing, not several; it has an elastic cord enclosed in a casing; and the spring toggle locking system is simple to use. The protector cannot be opened except when desired. My protector does not easily tear at the closure, and consequently there is no loss of airtight seal. Furthermore, due to the intrinsic adhesiveness of the inner membrane, it clings to the wet tool for longer and superior protection of the wet brush, roller, or similar tool.

Awadallah Ser. No. 13/986,143 is a U.S.P.T.O. application providing a rectangular-shaped polyethylene paint tray cover with a drawstring closure. Adwallah attempts to solve a different problem from that solved by my invention. The Awadallah Tray Saver is 16 inches by 22 inches, made to fit around 9 inch paint trays. This large size bag is not capable of use to hold wet paint brushes or rollers because air would be trapped inside the large bag that would damage the brush or roller. The brush or roller would slide around the large bag, losing the paint in the bristles or on the roller cover, which would be spread out on the inside walls of the large bag, thereby causing a loss of expensive paint, and predisposing the paint brush or roller to dry out without paint covering it, and thus be damaged.

My protector is reusable or disposable at the option of the user, is for short-term use, is simple and fast to use, has a secure locking system, allows less air inside the protector, withstands impacts, and indicates the product is working.

OPERATION

Summary of the Invention

In one embodiment, a protector for a paint brush, roller or other paint applicator comprising a sheath of impermeable flexible material. Said sheath is comprised of two membranes. The inner membrane is polyethylene vinyl acetate, or ethylene vinyl acetate, which is biodegradable and non-chlorinated. This provides intrinsic adhesiveness thereby improving performance. The surface of said membrane has a frosted or translucent appearance. This membrane adheres to the paint on the tools for an improved barrier between the paint and oxygen. When the wet surface of the tool makes contact with the frosted membrane, the wet or paint shows through more clearly, while the dry areas maintain a frosted appearance, thereby indicating the product is working. The outer membrane is polyethylene plastic, which has a high ductility and impact strength. The outer layer provides an extra barrier against moisture and air and also acts as an extra layer of strength to protect against any punctures. Because this membrane is polyethylene plastic, when holding a wet brush or roller, it can withstand impacts, such as dropping or knocking against other tools. Furthermore, even if the outside layer were punctured, the tools will still be protected by the inside membrane. This feature provides superior protection compared to other protectors in job sites where items commonly left in the work area could damage or puncture other protectors when set down.

This embodiment is in the shape of a trapezoid, the perimeter of which is closed on all sides except one, which is open. The open side is parallel to and longer than the closed side so that the sheath narrows from the open side toward the closed side. A casing is at the open end. An elastic cord is threaded through a small hole in the outer side of the casing, through the casing, and out of the hole. A spring toggle lock is attached to the cord. This closure securely seals the protector in an air-tight manner around the neck of the paint brush or roller handle and can only be opened when the user desires it open. It will not inadvertently fall open or be pulled open. The elastic cord and lock provide the user the control to adjust the seal that fits, or works, best for each painting tool.

DRAWINGS—FIGURES

Figure 1B:
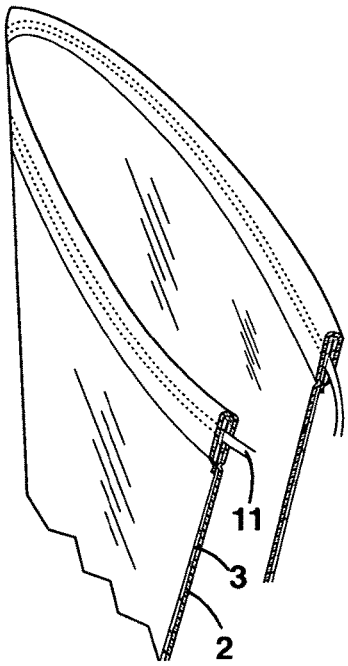
Figure 1C:
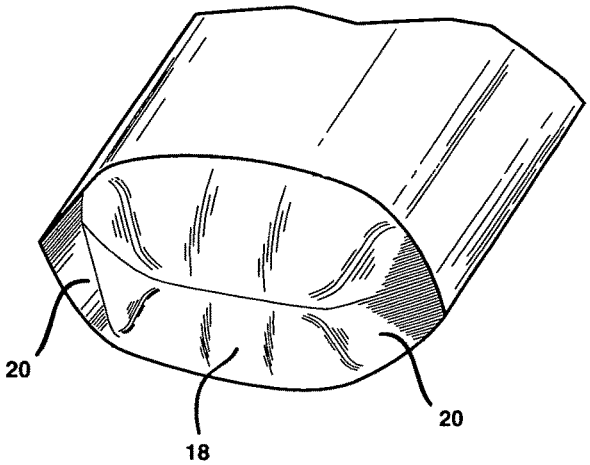
Figure 2:
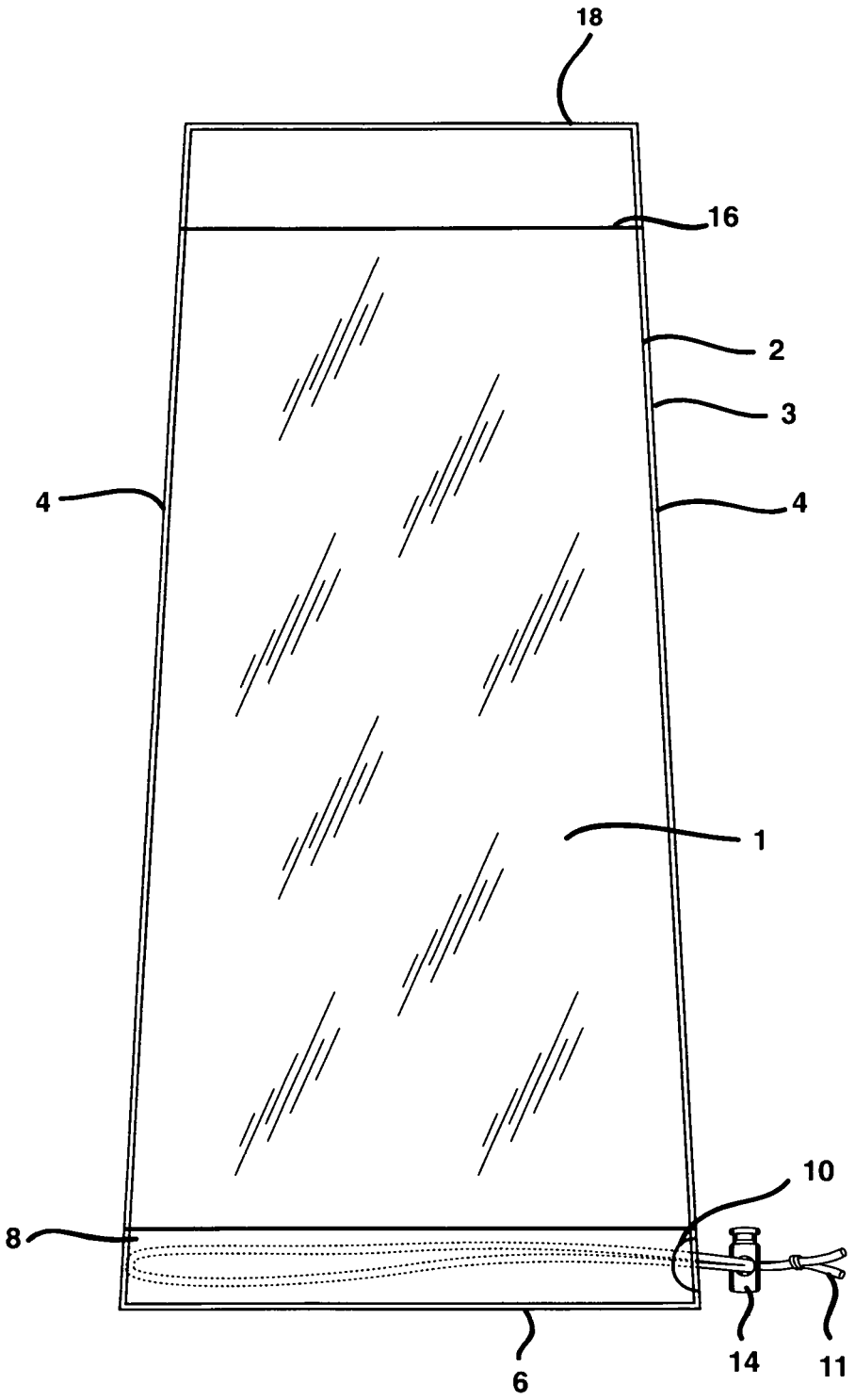
Figure 3A:
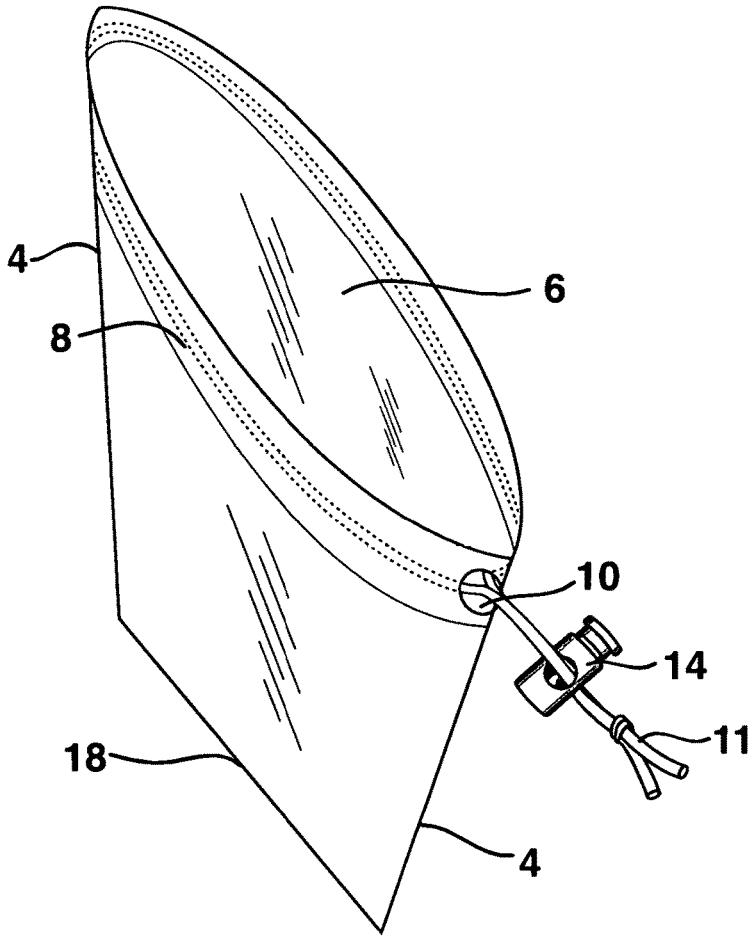
Figure 3B:
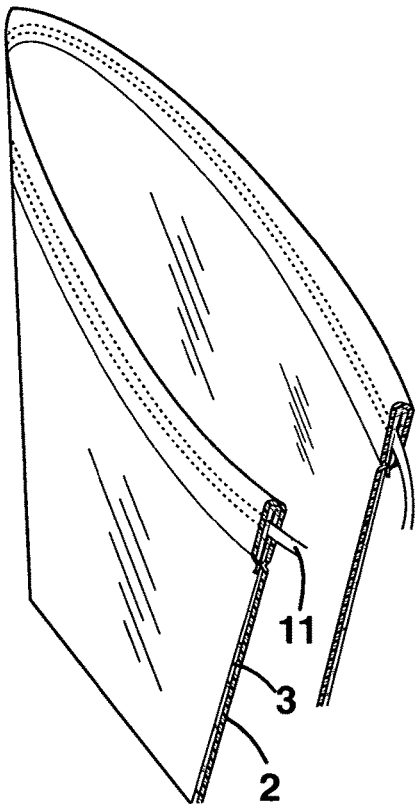
Figure 4:
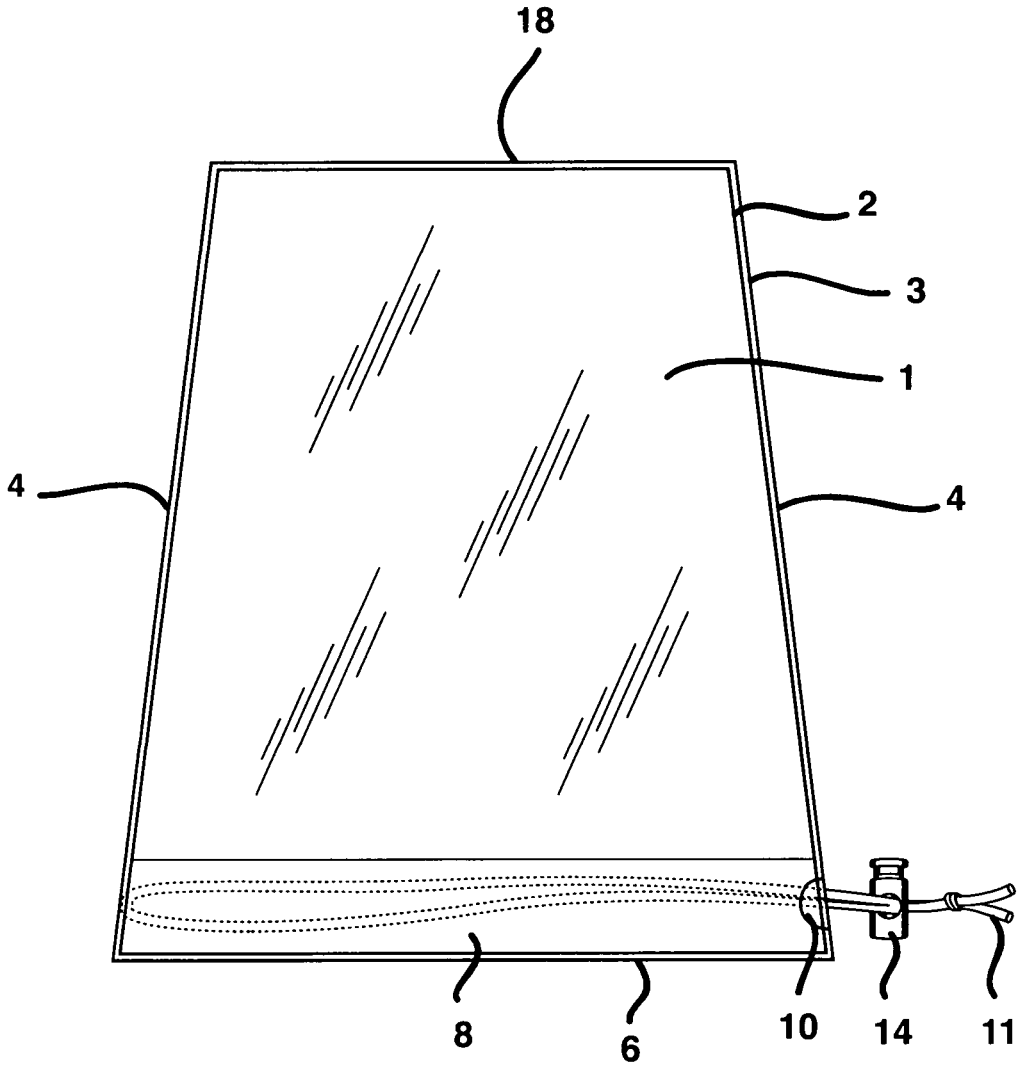
Figure 5:
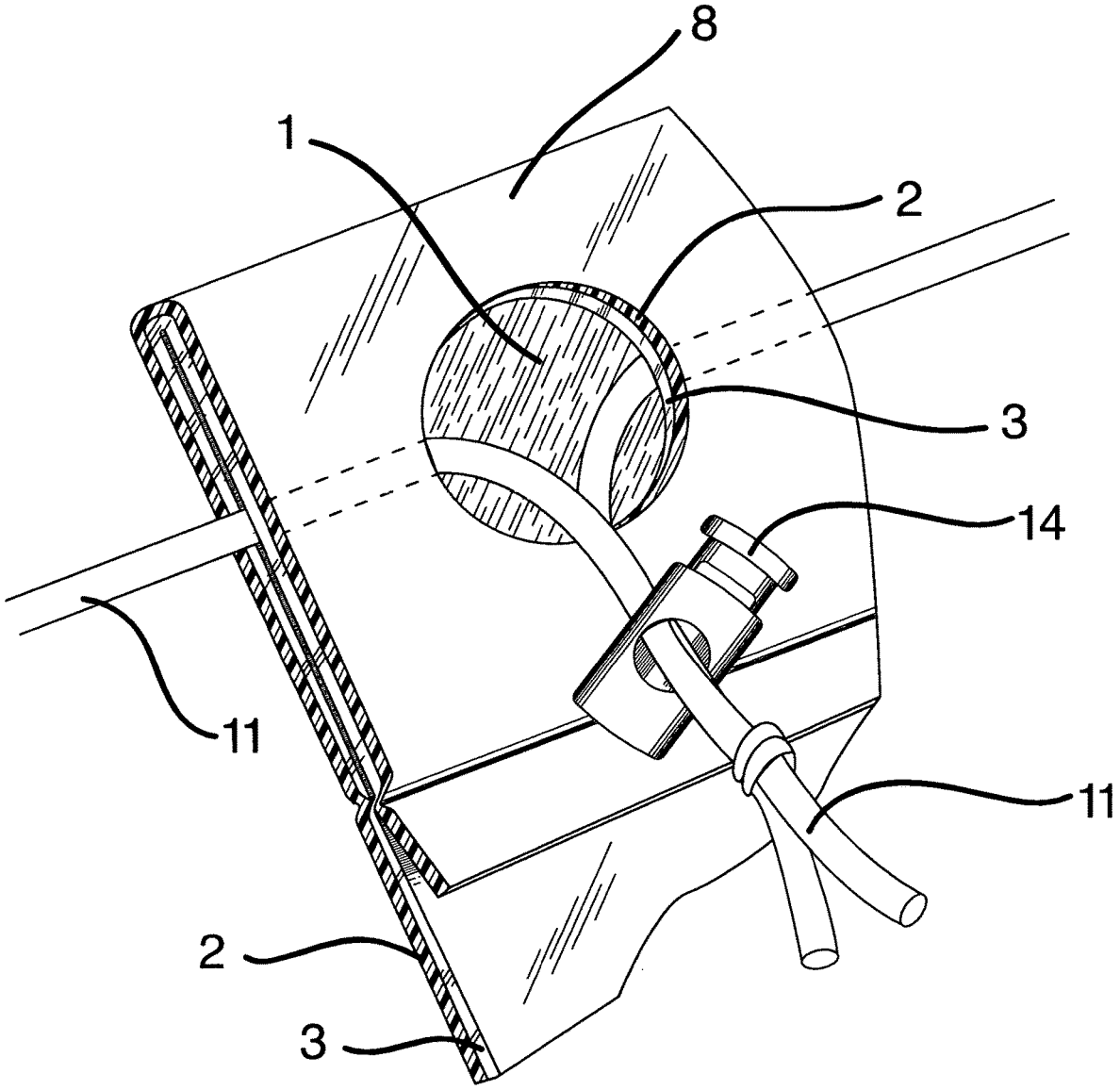
Figure 6:
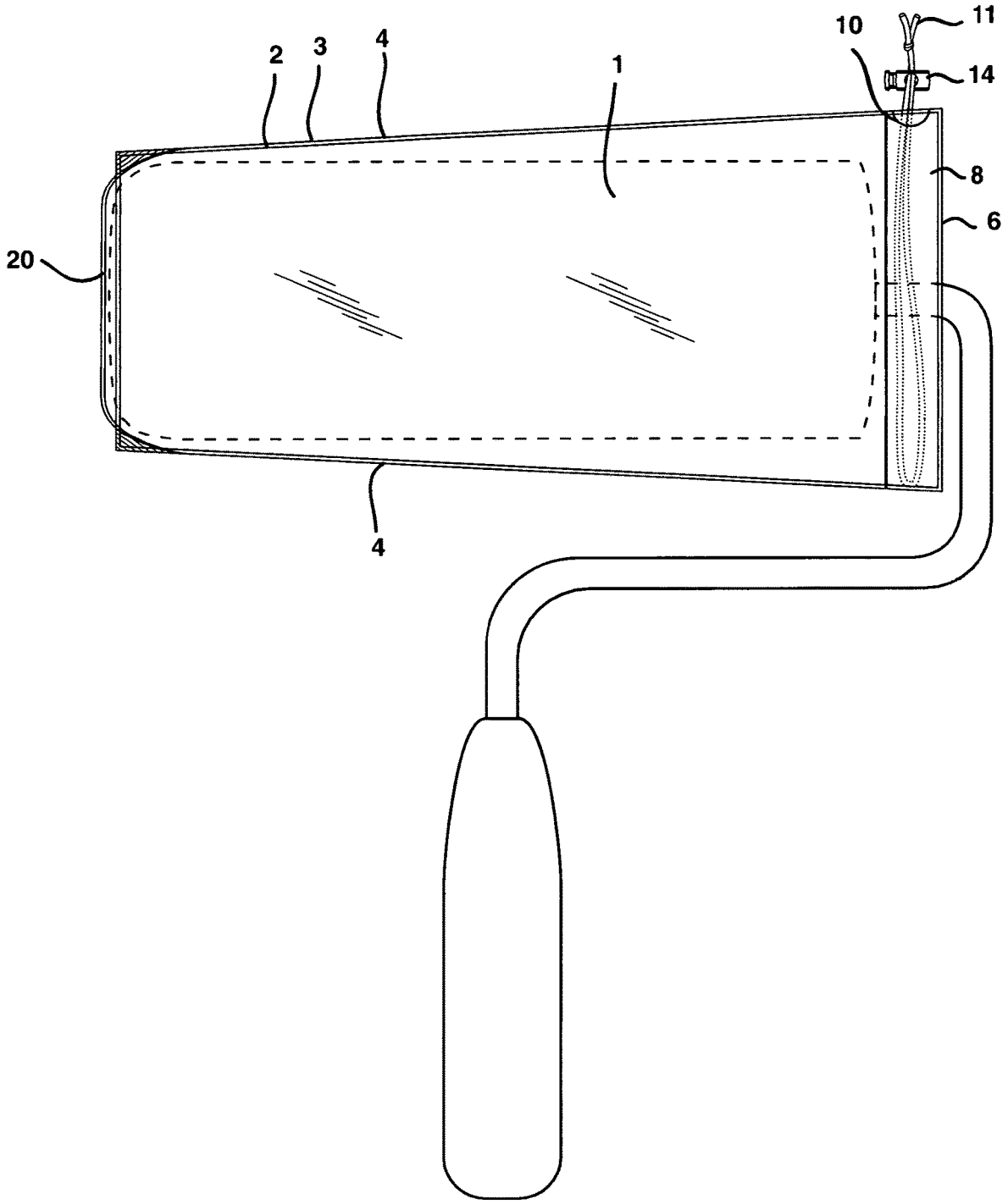
Figure 7:
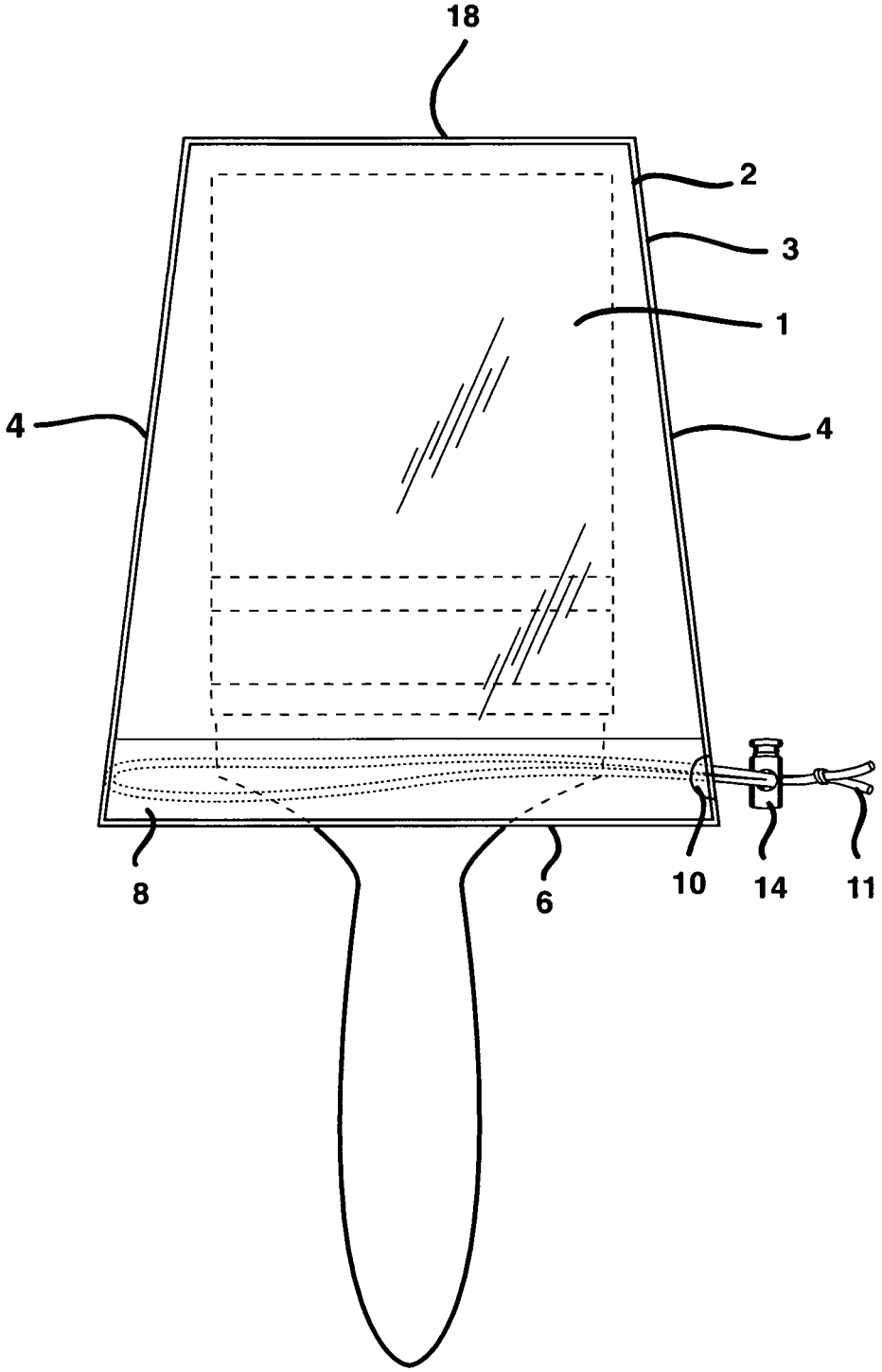
Figure 8:
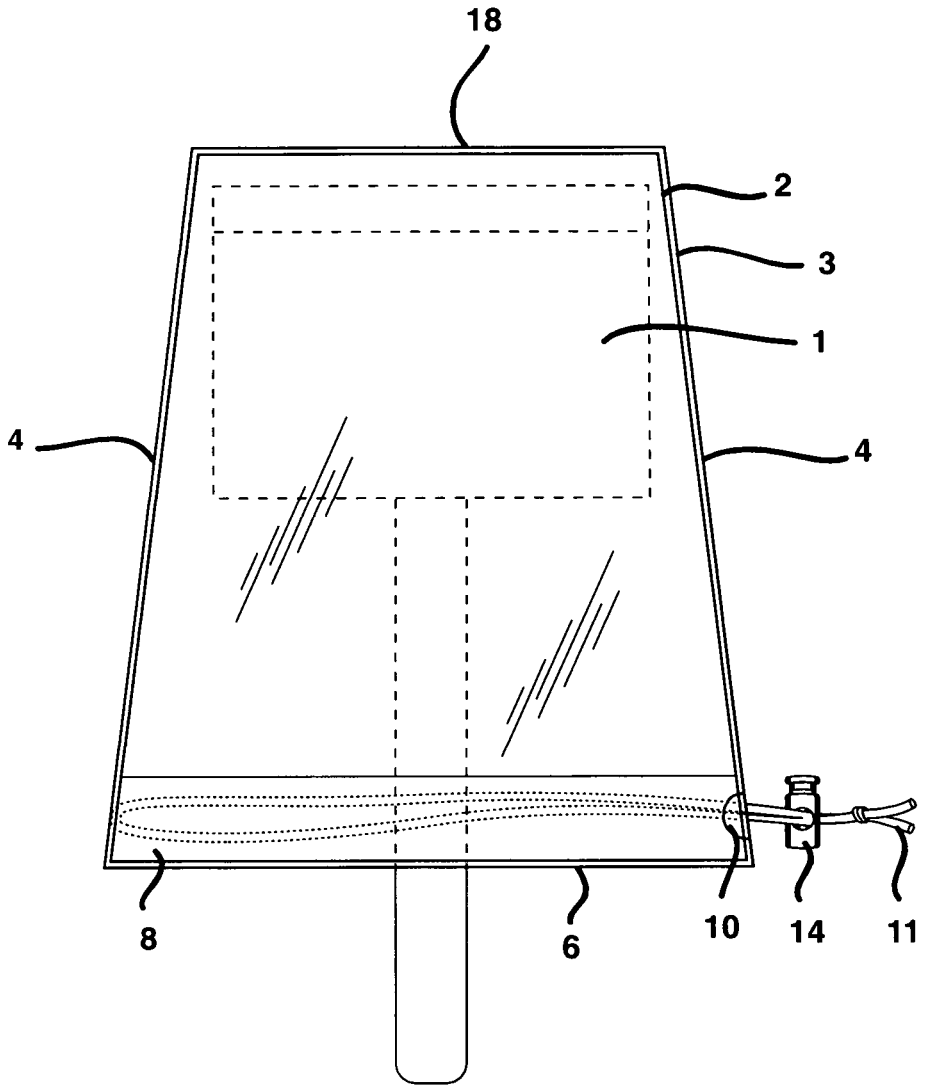
Figure 9:
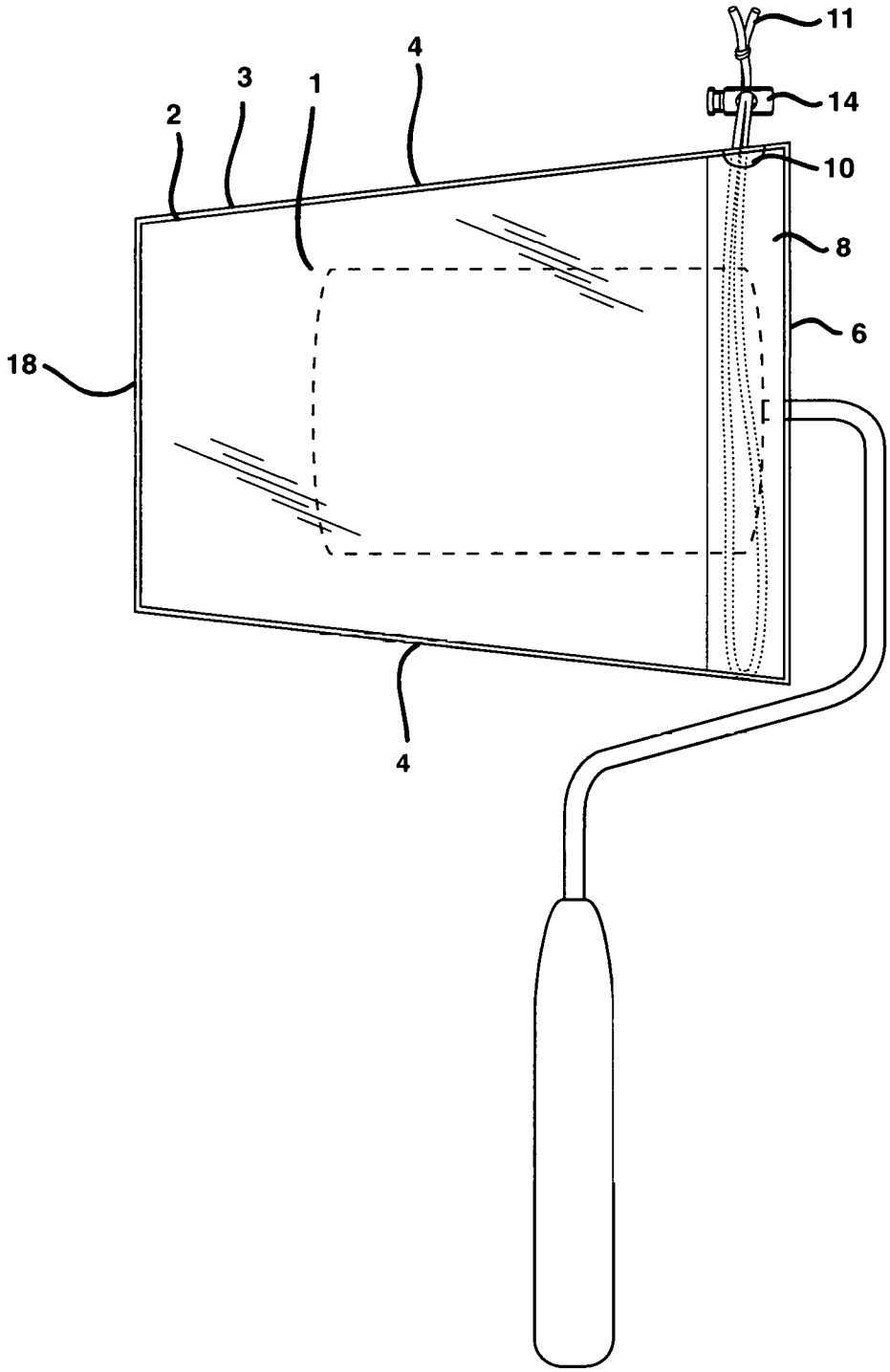

FIG. 1A is a perspective view of the paint roller protector with the gusset open FIG. 1B is a partial detail view showing the two membranes FIG. 1C is a detail view of the open gusset FIG. 2 is a top view of the paint roller protector with the gusset closed FIG. 3A is a perspective view of the paint brush protector FIG. 3B is a detail view showing the two membranes FIG. 4 is a top view of the paint brush protector FIG. 5 is a detail view of the closure showing the two membranes FIG. 6 is a top view of a roller inside a protector with a gusset FIG. 7 is a top view of a brush inside a protector FIG. 8 is a top view of a foam brush inside a protector FIG. 9 is a top view of a detail roller inside a protector

DRAWINGS—REFERENCE NUMERALS

1 impermeable flexible material
2 inner membrane
3 outer membrane
4 side
6 opening
8 casing
10 hole
11 elastic cord
12 cord
14 lock
16 closed gusset
18 closed end
20 bottom of expanded gusset

DETAILED DESCRIPTION

FIGS. 1A, 1B, 1C, 2

One embodiment of the protector is illustrated in FIGS. 1A (perspective view), 1B (partial detail perspective view), 1C (end partial view) and 2 (top view). The protector comprises a sheath of impermeable flexible material 1 (FIG. 2) with an inner membrane 2 (FIGS. 1B, 2) and an outer membrane 3 (FIGS. 1B, 2), in the shape of a trapezoid, the perimeter of which is closed on all sides 4 and 18 (FIGS. 1A, 2), except one 6 (FIGS. 1A, 2), which is open. The opening 6 (FIGS. 1A, 1B, 2) is parallel to and longer than the closed end 18 (FIGS. 1A, 2). The two sides 4 (FIGS. 1A, 2) narrow from the opening 6 (FIGS. 1A, 2) to the closed end 18 (FIGS. 1A, 2). A short length of the material 1 (FIGS. 1A, 1B, 2) at the opening 6 (FIGS. 1A, 2) is folded inside the protector and the circumference of which is adhered to the protector to form a casing 8 (FIGS. 1A, 2). A small hole 10 (FIGS. 1A, 2) is cut into the outer portion of the casing 8 (FIGS. 1A, 2) and an elastic cord 11 (FIGS. 1A, 1B, 2) is threaded into the hole 10 (FIGS. 1A, 1B, 2), through the casing 8 (FIGS. 1A, 1B, 2), and then out of the hole 10 (FIGS. 1A, 2). A lock 14 (FIGS. 1A, 2) is attached to the exposed portion of the elastic cord 11 (FIGS. 1A, 2).

FIGS. 3A, 3B, 4—Additional Embodiment

FIG. 3A shows a perspective view and FIG. 4 shows a top view of the protector for a paint brush or similar tool. FIG. 3B shows a detail view of the membranes of the protector. The protector comprises a sheath of impermeable flexible material 1 (FIG. 4), in the shape of a trapezoid, the perimeter of which is closed on all sides 4 and 18 (FIGS. 3A, 4), except one 6 (FIGS. 3A, 4), which is open. The opening 6 (FIGS. 3A, 4), of the protector and the casing 8 (FIGS. 3A, 4), around the opening 6 (FIGS. 3A, 4), can be seen. The elastic cord 1 (FIGS. 3A, 4), is threaded into a small hole 10 (FIGS. 3A, 4), in the casing, through the casing 8 (FIGS. 3A, 4), and out of the hole 10 (FIGS. 3A, 4). A lock 14 (FIGS. 3A, 4), is attached to the exposed portion of the elastic cord 11 (FIGS. 3A, 4).

FIGS. 5-9

FIG. 5 shows a detail view of the closure disclosing the two membranes 2, 3 (FIG. 5). FIG. 6 shows a roller placed inside a protector. The end of the roller has opened the gusset and is snugly covered. FIG. 7 shows a paint brush inside a protector. FIG. 8 shows a foam brush inside a protector and FIG. 9 shows a detail roller in a protector. FIGS. 7-9 show the versatility of the protector; it can be used for many different tools.

Operation—FIGS. 1A, 2, 3A, 3B, 4

The user places the paint brush bristles or paint roller places the roller arm assembly through the opening 6 into the protector up to the handle, which extends out of the protector. The handle will extend out of the protector. The user of any other paint applicator places the applicator portion of the paint applicator through the opening 6 into the protector. The protector is then closed by sliding the lock 14 along the elastic cord 11 (or other cord 12) toward the protector until the protector is substantially closed, press the protector around the brush, roller or applicator to remove any air in it, and then resume sliding the lock 14 along the elastic cord 11 (or other cord 12) toward the protector until the protector is fully closed. Alternately, one can slide the lock 14 along the elastic cord 11 (or other cord 12) toward the protector until the protector is fully closed around the brush, roller or applicator, as the case may be. Operationally, the advantages of my invention are:

(1) The advantages of the double membranes are: the inner membrane provides adherence to the paint on the tool for an improved barrier between the paint and oxygen; the outer membrane provides an extra barrier against moisture and air as well as protects against punctures.

(2) The translucent surface of the inner membrane indicates the product is working.

(3) The intrinsic adhesiveness of the inner membrane causes the protector to cling to the paint and tool for longer and enhanced protection.

(4) The outer membrane has high ductility and impact strength and when in use, can withstand impacts, such as dropping or knocking against other tools.

(5) The trapezoid shape of my protector provides users a faster, easier, and neater solution to protecting their tools because it has more width space and more area space at entry point than a simple rectangle.

(6) The gusset provides superior protection to rollers or similarly shaped paint applicators by tightly conforming to their shape. My protector neatly fits around a roller and provides better protection since there is less air space next to the roller.

(7) The elastic cord and spring toggle locking system make my protector simple to use and reuse. With it, the user can control the seal that fits best for each painting tool, far superior to closures in the prior references. The casing at one end, the elastic cord, and spring toggle locking system keep the protector from being inadvertently torn. The lock secures the brush and will not open until the user desires it to be opened.

(8) My protector is reusable or disposable.

ALTERNATIVE EMBODIMENTS

In other embodiments, the protector may be of various sizes or shapes to closely fit different tools. The membranes of the impermeable material may be different thicknesses or appearance. A different means may be used for the closure.

Advantages

From the description above, a number of advantages of some embodiments of my protector become evident:

(a) The inner membrane provides adherence to the paint on the tool for an improved barrier between the paint and oxygen; the outer membrane provides an extra barrier against moisture and air as well as protects against punctures.

(b) The translucent surface of the inner membrane indicates the product is working.

(c) The composition of the inner membrane provides intrinsic adhesiveness and thereby improves performance.

(d) The outer membrane has high ductility and impact strength and, when in use, can withstand impacts, such as dropping or knocking against other tools.

(e) The casing is stronger, the elastic tighter, and the lock is more secure than found in prior art.

(f) The novel features of my invention all combine to create a much stronger, more secure, and more attractive protector.

(g) The protector is much easier to use than the prior art.

(h) Only one hand is needed to hold the protector, while the other hand is holding the brush or roller.

(i) The shape increases protection by minimizing the air space around the brush or other paint applicator. The wide opening allows for easy placement.

(j) The brush or roller easily slips into the protector without the need for the user's hands to touch wet paint.

(k) The protector is more convenient than existing products. It can be stored in the user's pocket prior to use so that it is immediately available upon its need with no search undertaken or extra time taken to locate it, which would allow the paint or stain on the brush or roller to begin to dry and possibly damage the brush or roller.

(l) After use, the protector can be discarded or cleaned and reused at the user's discretion.

(m) The protector is inexpensive to manufacture, package, and market.

(n) The protector is easy and inexpensive to distribute.

(o) The protector provides a better-appearing design than the prior art.

(p) Due to the low cost of the protector, many painters will desire to use it in order to protect more expensive painting equipment and thereby save money and materials.

(q) When the gusset is folded shut, the protector lays flat and smooth, which provides for easier handling, packaging, and storage of the protectors. No part of the gusset is exposed to being opened or caught on machinery, tools or anything else.

(r) When in use, the gusset expands within the protector, allowing the protector to maintain a low profile that is less likely to catch or snag on nearby tools or items than a flat protector.

(s) The gusset provides a tighter fit around the roller than a flat protector, which is desirable because a tight fit with no air space optimizes the preservation of paint and roller for later use, and better protects the roller from damage or drying out if wet with paint, stain, or similar application.

(t) The gusset minimizes the amount of materials needed for the protector for a paint roller compared to a flat protector.

(u) The trapezoid shape provides the user 44% more width space at entry point, and 50% more area space at entry point than a simple rectangle. The revolutionary trapezoid bag increases the space ratio between the painting tools at entry point, thus providing a faster, more convenient, less messy solution for the user.

(v) The closure is superior to those found in prior art.

(w) One size of the protector fits multiple painting tools, such as brushes, foam applicators and detail rollers.

(x) The elastic cord and lock provide the user the control to adjust the seal that fits, or works, best for each painting tool.

CONCLUSION, RAMIFICATIONS, AND SCOPE

Thus the reader will see that at least one embodiment of the protector provides a secure, convenient, fast and easy to use, and economical protector with minimal air space when in use that can be used by most anyone and is reusable or disposable.

While the description above contains many specificities, these should not be construed as limiting the scope of the embodiment but as merely providing illustrations of some of the presently preferred embodiments. Many other variations are possible. For example, the protector may be of various sizes or shapes. The membranes of the impermeable material may be different thicknesses or appearance.

Thus the scope of the embodiments should be determined by the appended claims and their legal equivalents, rather than by the examples given.

What is claimed is:

1. A protective cover adapted for storing a paint applicator, the protective cover comprising:

a sheath constructed of an impermeable, flexible material, the sheath having:

an open end, a closed end, and sides extending between the open end and the closed end, with the open end having a greater width than the closed end; and a membrane adapted to contact a paint applicator inserted into the sheath, with the membrane having a translucent appearance when dry and having a more transparent appearance when wet than when dry;

a partially enclosed channel adjacent to and around a perimeter of the open end of the sheath, with the channel having an inner wall on an inside of the sheath and an outer wall on an outside of the sheath;

an elastic cord running through the channel and having opposite ends exiting the channel through an aperture, with the aperture formed only in the outer wall of the channel such that the aperture does not extend into the inner wall of the channel; and a slidable lock positioned on the opposite ends of the elastic cord and adapted to interact with the elastic cord to secure the open end of the sheath in a substantially closed position.

2. The protective cover of claim 1 wherein the protective cover is configured to store one of a brush, roller, or foam applicator.

3. The protective cover of claim 1 wherein the membrane comprises an inner membrane and with the sheath further including an outer membrane, with the inner membrane constructed of a different material than the outer membrane.

4. The protective cover of claim 3 wherein the channel is formed by folding back at least one of the inner membrane or the outer membrane.

5. The protective cover of claim 1 wherein the closed end of the sheath includes a gusset.

6. The protective cover of claim 5 wherein the gusset enables expansion of the closed end of the sheath such that the sides of the sheath can separate.

7. The protective cover of claim 1 wherein the membrane comprises one of polyethylene vinyl acetate or ethylene vinyl acetate.

8. The protective cover of claim 3 wherein the outer membrane comprises polyethylene plastic.

9. The protective cover of claim 1 wherein the sheath has a trapezoidal shape, the perimeter of which is closed on the closed end and sides.

10. A protective cover adapted for storing a paint applicator, the protective cover comprising:

a sheath constructed of an impermeable, flexible material, the sheath having:

an open end, a closed end, and sides extending between the open end and the closed end; and a membrane adapted to contact a paint applicator inserted into the sheath, with the membrane having a translucent appearance when dry and having a more transparent appearance when wet than when dry;

a partially enclosed channel adjacent to and around a perimeter of the open end of the sheath, with the channel having an inner wall on an inside of the sheath and an outer wall on an outside of the sheath;

an elastic cord running through the channel and having opposite ends exiting the channel through an aperture, with the aperture formed only in the outer wall of the channel such that the aperture does not extend into the inner wall of the channel; and a slidable lock positioned on the opposite ends of the elastic cord and adapted to interact with the elastic cord to secure the open end of the sheath in a substantially closed position.

11. The protective cover of claim 10 wherein the sheath has a trapezoidal shape, the perimeter of which is closed on the closed end and sides.

12. The protective cover of claim 10 wherein the protective cover is configured to store one of a brush, roller, or foam applicator.

13. The protective cover of claim 10 wherein the membrane comprises an inner membrane and with the sheath further including an outer membrane, with the inner membrane constructed of a different material than the outer membrane.

14. The protective cover of claim 10 wherein the closed end of the sheath includes a gusset.

15. The protective cover of claim 14 wherein the gusset enables expansion of the closed end of the sheath such that the sides of the sheath can separate.

16. The protective cover of claim 10 wherein the membrane comprises one of polyethylene vinyl acetate or ethylene vinyl acetate.

17. A protective cover adapted for storing a paint applicator, the protective cover comprising:

a sheath constructed of an impermeable, flexible material, the sheath having:

an open end, a closed end, and sides extending between the open end and the closed end, with the open end having a greater width than the closed end; and a membrane adapted to contact a paint applicator inserted into the sheath, with the membrane having a translucent appearance when dry and having a more transparent appearance when wet than when dry;

a partially enclosed channel adjacent to and around a perimeter of the open end of the sheath, with the channel having an inner wall on an inside of the sheath and an outer wall on an outside of the sheath;

an elastic cord running through the channel and having opposite ends exiting the channel through an aperture, with the aperture formed only in the outer wall of the channel such that the aperture does not extend into the inner wall of the channel; and a slidable lock positioned on the opposite ends of the elastic cord and adapted to interact with the elastic cord to secure the open end of the sheath in a substantially closed position;

wherein the open end of the sheath is adapted to be selectively opened to enable insertion of a paint applicator and closed to secure the open end of the sheath in a substantially closed position around a handle of the paint applicator, using the partially enclosed channel, the elastic cord, and the slidable lock.

18. The protective cover of claim 17 wherein the membrane comprises an inner membrane and with the sheath further including an outer membrane, with the inner membrane constructed of a different material than the outer membrane.

19. The protective cover of claim 17 wherein the closed end of the sheath includes a gusset.

20. The protective cover of claim 17 wherein the membrane comprises one of polyethylene vinyl acetate or ethylene vinyl acetate.

* * * * *